United States Patent [19]

Ishii et al.

[11] Patent Number: 4,875,519

[45] Date of Patent: Oct. 24, 1989

[54] METHOD OF MANUFACTURING HOLLOW BILLET AND APPARATUS THEREFOR

[75] Inventors: Yoh Ishii, Oyama; Masami Abe, Tochigi; Yuhzoh Harada, Oyama; Atsumi Takasugi, Oyama; Kazumi Kato, Oyama, all of Japan

[73] Assignee: Furukawa Aluminum Co., Ltd., Tokyo, Japan

[21] Appl. No.: 185,436

[22] Filed: Apr. 25, 1988

[30] Foreign Application Priority Data

Apr. 30, 1987 [JP] Japan ..... 62-107749

[51] Int. Cl.[4] ..... B22D 11/04

[52] U.S. Cl. ..... 164/465; 164/421; 164/444; 164/475; 164/487

[58] Field of Search ..... 164/465, 421, 475, 487, 164/444

[56] References Cited

FOREIGN PATENT DOCUMENTS

| | | | |
|---|---|---|---|
| 837589 | 4/1952 | Fed. Rep. of Germany . | |
| 2321064 | 12/1974 | Fed. Rep. of Germany | 164/465 |
| 54-42847 | 12/1979 | Japan . | |
| 57-109546 | 7/1982 | Japan | 164/465 |
| 58-97463 | 6/1983 | Japan | 164/465 |
| 60-72645 | 4/1985 | Japan | 164/465 |
| 60-39456 | 9/1985 | Japan . | |
| 61-1961 | 1/1986 | Japan . | |
| 61-135452 | 6/1986 | Japan . | |
| 62-89549 | 4/1987 | Japan | 164/465 |

OTHER PUBLICATIONS

E. Lossak: Stranggiessen, 1986, Verlag DGM Informationsges, Oberursel, pp. 139–142; W. Schneider "Aluminium-Walzbarrenstrangguss mit Hot Top Kokillen".

*Primary Examiner*—Nicholas P. Godici
*Assistant Examiner*—J. Reed Batten, Jr.
*Attorney, Agent, or Firm*—Frishauf, Holtz, Goodman & Woodward

[57] ABSTRACT

A method and apparatus utilizing a core is located at a central portion of a molten metal storing portion in a vertical semi-continuous mold. The molten metal is poured into the molten metal storing portion, and casting takes place with the inner diameter of a solidified distal portion of the molten metal being controlled by a distal portion of the core. This approach provides a reliable method for the manufacture of high-quality hollow billets which are free from internal defects.

6 Claims, 7 Drawing Sheets

METHOD OF MANUFACTURING HOLLOW BILLET AND APPARATUS THEREFOR

BACKGROUND OF THE INVENTION

1. Field of the Invention

The present invention relates to a method of reliably manufacturing hollow billets made of nonferrous metals—in particular, molten aluminum alloys having various compositions—by use of a vertical semi-continuous hot top casting method (to hereinafter be referred to simply as a hot top casting method), and an apparatus for manufacturing the same.

2. Description of the Related Art

The hot top casting method and the direct chill casting method are both known conventional methods used for forming billets by way of casting, for example, aluminum and alloys thereof.

A typical hot top casting method is described in Japanese Patent Publication No. 54-42847. According to the method described therein, a large quantity of molten metal is stored beside an upper refractory structure and is solidified by a lower water-cooled mold. This method permits the manufacture of high-quality billets which are free from internal defects. In this case, the billets manufactured are solid billets which are subsequently extruded.

When pipes are to be manufactured by way of mandrel extrusion, the extrusion billet should preferably be hollow in order to obtain a higher yield and for ease of manufacture. Consequently, there is now considerable demand for the development of a method by means of which billets can be manufactured in hollow form.

Attempts have been made to manufacture hollow billets by use of the hot top casting method. The hot top casting method is characterized in that a large quantity of molten metal is stored beside an upper refractory structure.

For this reason, contraction upon solidification of molten metal occurs in the hollow portion of the billet during the solidification process. A force for drawing a core into a billet is always generated during casting. As a result, if the core was drawn into the billet during casting, a large quantity of molten metal is poured on cooling water to often cause a steam explosion. The hot top casting method is not used in practice to manufacture hollow billets.

Attempts have also been made to manufacture hollow billets by use of the direct chill casting method. According to this method, a turbulence occurs in molten aluminum by a floating distributor and a spout of a movable part for adjusting a molten surface level. As a result, an oxide produced by the above turbulence inevitably enters the hollow billets, degrading the quality of the billets produced.

As a result of extensive studies carried out by the present inventors in relation to the problems experienced when using the above manufacturing methods, a "method of manufacturing hollow billets and an apparatus therefor" was developed and subsequently presented as Japanese Patent Application No. 62-107749 which constitutes the priority document of the present application.

According to this method, a core is positioned at the center of a mold and the distal end of the core is projected from the solidifying portion of the molten metal, thereby manufacturing hollow billets. However, when graphite is used to form the entire core of a lower part of the core, the surface of the graphite core becomes thermally worn and is corroded and degraded. The degraded graphite core surface has a large friction coefficient against the hollow portion to roughen the inner surface of the hollow portion. It is found that an accident such as leakage of the molten metal may eventually occur. It is also found that such a variation in molten surface level occurs particularly in the initial period of casting.

SUMMARY OF THE INVENTION

It is an object of the present invention to provide a method of safely and reliably manufacturing high-quality hollow billets which are free from internal defects, and an apparatus for manufacturing the same.

It is another object of the present invention to provide a method by means of which high-quality billets free from internal defects can be manufactured, even when the manufacturing process involves use of a graphite core.

It is yet another object of the present invention to provide a method of reliably manufacturing high-quality hollow billets which are free from internal defects and have a smooth inner surface, wherein a strong molten flow does not directly collide against a core to stabilize solidification of the molten metal near the core.

According to the present invention, there is provided a method of manufacturing a hollow billet, which comprises the steps of: disposing a core at a central part of a molten metal storing portion surrounded by an upper refractory heat-insulating portion of a vertical semi-continuous casting mold comprising the heat-insulating portion, a lower cooling portion, and a lubricant supply port formed between the heat-insulating portion and the cooling portion; horizontally supplying, from one direction, a molten metal to the molten metal storing portion; and casting the molten metal, with cooling being provided by the cooling portion, and an inner diameter of a solidified distal portion of the molten metal being controlled by a distal portion of the core.

More precisely, the inner diameter of the solidified distal portion of the molten metal is controlled such that the distal portion of the core is dipped in the molten metal storing portion, so that the distal portion of the core is projected from the molten metal distal portion gradually solidified by cooling of the outside cooling portion.

The present invention additionally includes a method of casting molten metal whereby a core, the lower portion or the entire body of which consists of graphite, is used to control the inner diameter of the solidified distal portion with an inert gas filled in a hollow portion of a solidified distal portion of the molten metal from a through-hole formed in the core.

The present invention further includes a method of casting the molten metal whereby the molten metal is horizontally supplied, from a single direction, to control the inner diameter of the solidified distal portion of the molten metal by a core and a molten metal regulating member arranged at a molten metal flow inlet port between the core and the molten metal storing portion controls a direction of the molten metal flow.

The present invention, moreover, provides an apparatus for manufacturing a hollow billet, which comprises: a vertical semi-continuous casting mold including an upper refractory heat-insulating portion, a lower cooling portion, a lubricant supply port formed between the cooling portion and the heat-insulating portion, and a molten metal storing portion surrounded by the heat-insulating portion; and a core disposed at a central portion of the molten metal storing portion.

The core is preferably disposed in the molten metal storing portion such that the distal portion of the core is projected from the solidifying portion cooled by outside of the molten metal.

The upper portion of the core should preferably be made of a refractory material such as Marinite (trademark), available from Johns-Manville Products Corp., and its lower portion from any one of graphite, silicon nitride, silicon carbide, or boron nitride.

The present invention will be described in detail with reference to the accompanying drawings.

Figure 1:
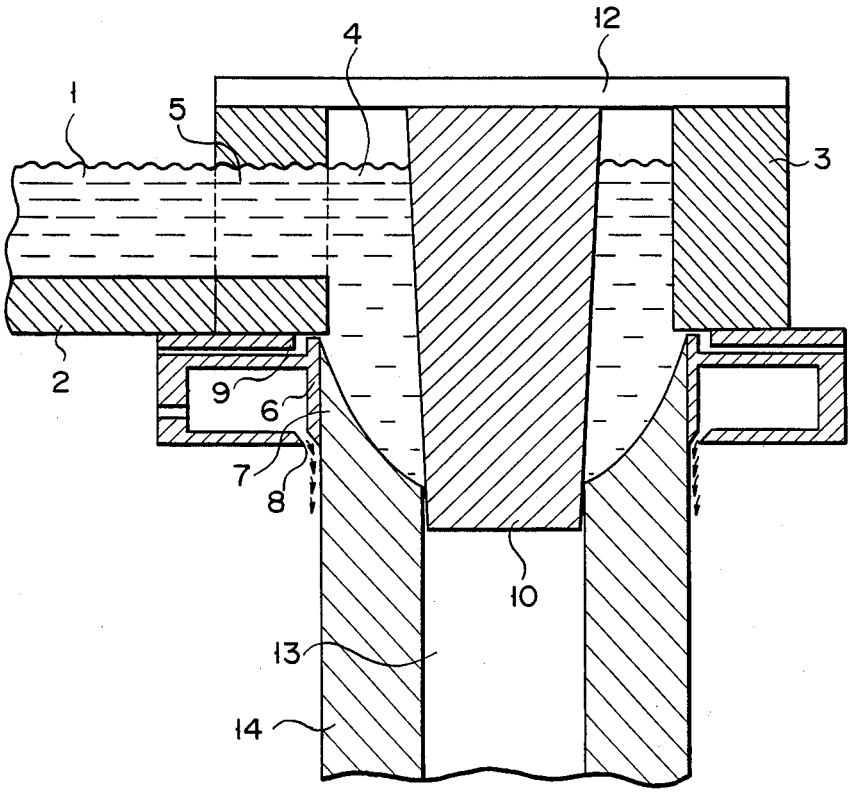
FIG. 1 is a sectional view showing an apparatus for manufacturing hollow billets used in a method of the present invention.

Referring to FIG. 1, reference numeral 1 denotes a molten metal such as a molten aluminum alloy. Molten metal 1 is supplied to casting trough 2 through a melting furnace and a molten metal filter line. Casting trough 2 is directly connected to molten metal storing portion 4 of upper refractory portion 3. Molten metal 1 is horizontally supplied from molten metal storage portion inlet port 5 without being through a movable member for adjusting a molten metal surface level (e.g., a floating distributor or a spout). Molten metal 1 supplied to refractory portion 3 is gradually moved downward as solidification progresses. When molten metal 1 is brought into contact with water-cooled metal portion 6 in the lower part of the heat-insulating portion, solidified shell 7 is formed from the outermost portion. The thickness of solidified shell 7 is increased, and the thick shell is guided to the lower end of the water-cooled metal portion. The shell is brought into direct contact with cooling water 8 and solidification of the shell progresses. The solidification startpoint is always a lower portion of the refractory molten metal storing portion. For this reason, lubricant supply port 9 is formed between upper refractory portion 3 and water-cooled metal portion 6 to form a lubricant boundary. Core 10 for forming a hollow portion is fixed on upper refractory portion 3 and is positioned at the central portion of the mold by support bar 12. In this case, the distal portion of core 10 is sufficiently longer than the molten metal distal portion solidified by direct water cooling. The solidified shell at the central portion is defined by the distal portion of the core, so that hollow portion 13 is formed in the solidified shell.

The core is tapered toward its distal end. Examples of the core material are a refractory material such as Marinite (trademark) available from Johns-Manville Products Corp., Lumiboard-L (trademark) available from Nitius Corp., Recepal (trademark) available from Asahi Sekimen K.K., graphite, and silicon nitride.

Figure 2:
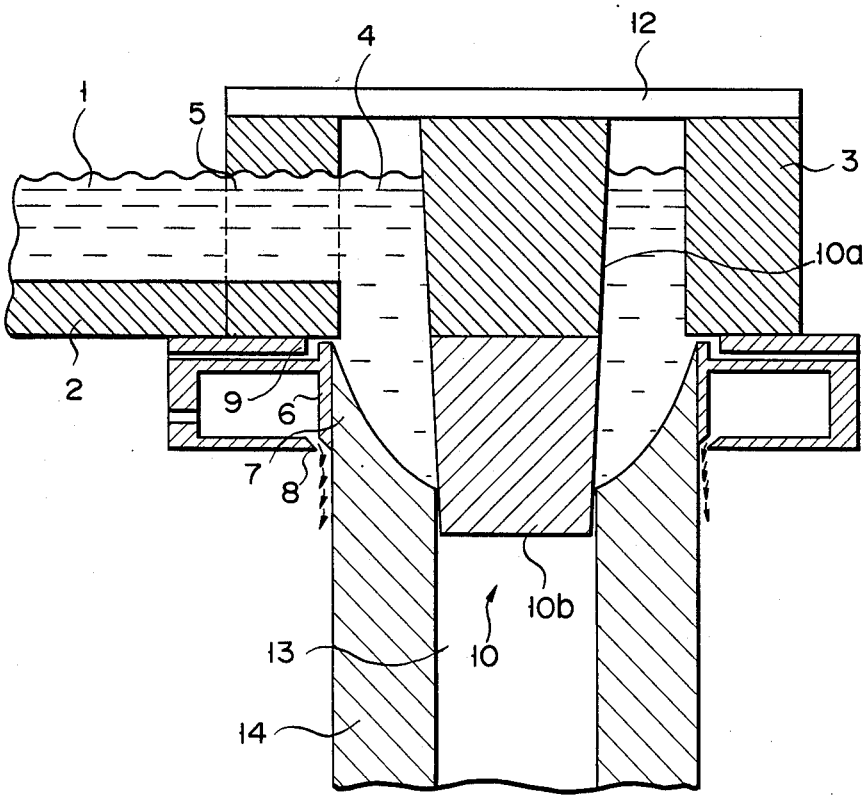
FIG. 2 is a sectional view corresponding to FIG. 1, but with a different core.

The structure of the core may be an integral body of a refractory or graphite material, as shown in FIG. 1. Alternatively, as shown in FIG. 2, a two-layered structure consisting of upper refractory core portion **10*a* and lower graphite (silicon nitride or silicon carbide) core portion 10*b*** may be employed.

In order to manufacture a hollow billet according to hot top casting without using a molten metal level adjusting mechanism, the two-layered structure obtained by combining the upper refractory portion and the lower graphite portion is better than that shown in FIG. 1. The two-layered structure is substantially free from influences of variations in molten metal level, and the surface of the cast product is smooth due to a lubricating effect of the lower graphite portion.

The graphite core portion need not be a solid graphite member but may be a hollow graphite member or a member covered with a graphite layer so as to reduce cost and a thermal capacity, thereby manufacturing billets having a uniform inner diameter.

A separate water cooling apparatus may be arranged below the core to cool the inner surface of the billet after the inner surface of the hollow billet is formed by the above core according to the present invention.

The present invention is characterized in that the distal portion of the core which does not incorporate any cooling means is projected from the fed end (solidified distal portion) of the molten metal so as to cause the graphite distal end of the core to define the solidified distal portion, thereby forming a hollow portion in the solidified distal portion. Since the core is not cooled with water, the inner surface of a hollow billet can be smooth. Even if the molten metal leaks inside the hollow portion, no steam explosion occurs and safe casting can be assured. Even if defects such as solidification/contraction cavities and voids are formed in a final solidified portion as an inner hollow portion, they are formed only inside the billet, and the value of the billet as a product is not impaired. In addition, since a large quantity of molten metal can be stored in the upper refractory portion, many advantages can be obtained such that variations in molten metal level in the pot are small.

The distal portion of the core is projected from the solidified distal portion of the molten metal by 30 mm or more. If the distal portion of the core is projected by a shorter distance than this value, the molten metal may leak. However, an excessively long distal portion of the core results in an economical disadvantage. Casting conditions such as a lowering rate of the billet, an amount of cooling water, and a temperature of a molten metal must be adjusted because they influence the quality of billets. Casting conditions slightly vary depending on the types of molten metal. In general, the lowering rate of the billet falls within the range of 50 mm/min to 120 mm/min, the amount of cooling water falls within the range of 150 l/min to 350 l/min, and the temperature of the molten metal falls within the range of 680° C. to 730° C.

Figure 3:
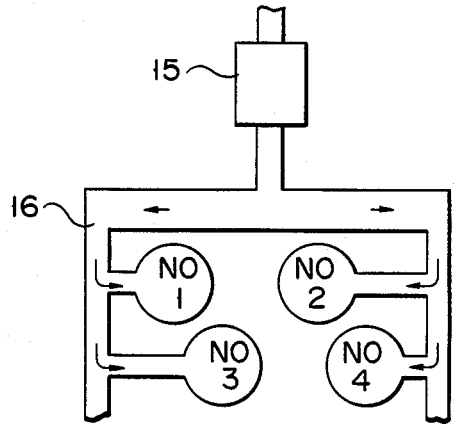
FIG. 3 shows a plurality of casting apparatuses receiving molten metal from a single supply source.

In order to practice the present invention, a plurality of casting apparatuses (four apparatuses No. 1 to No. 4 in FIG. 3) are connected to supply molten metal 1 from fitter box 15 through runner 16 in one direction of the upper refractory molten metal storing portion, thereby simultaneously casting a large number of billets.

When the core is entirely made of graphite (FIG. 4) or the core consists of an upper refractory portion and a lower graphite portion (FIG. 5), an inert gas is supplied to the lower graphite portion and near the hollow portion, both of which tend to be thermally worn, thereby preventing oxidation of graphite and hence casting hollow billets 14.

Figure 4:
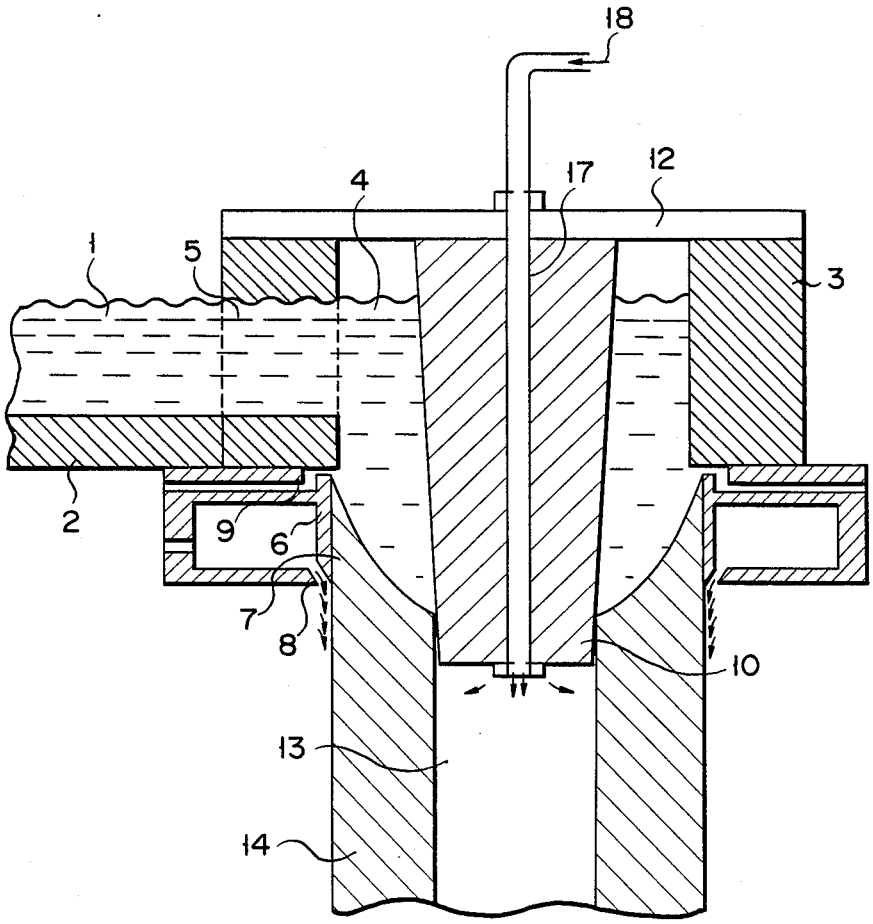
FIG. 4 is a view corresponding to FIG. 1, but showing a core with a through hole for injecting gas into the hollow interior of the formed billet.
Figure 5:
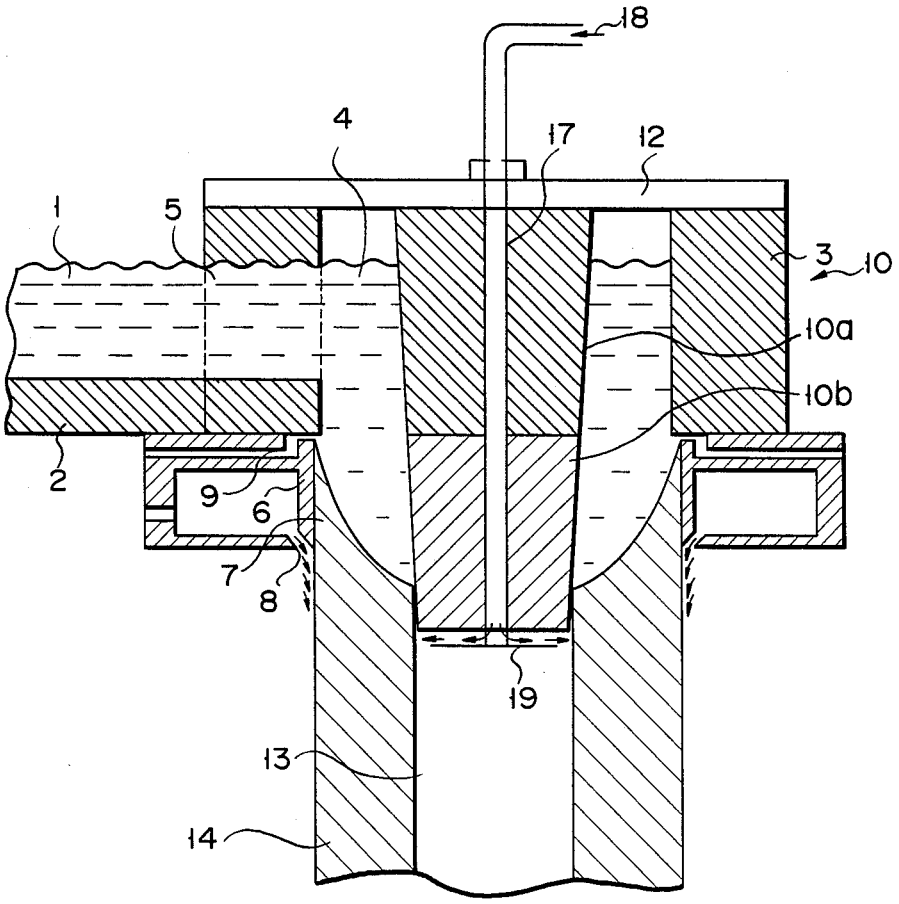
FIG. 5 is a view corresponding to FIG. 2, but showing a core with a through hole.

As shown in FIG. 4, gas supply pipe 17 is disposed at the center of graphite core 10, and inert gas 18 such as Ar, $N_2$, or carbon dioxide gas is supplied and filled in the lower graphite core portion and beside the hollow portion, thereby preventing its oxidation and wear. As shown in FIG. 5, gas supply pipe 17 extends through refractory portion 10*a* and lower graphite core portion 10*b*, and disc 19 is disposed therebelow. The gas supplied from the above collides against disc 19 and flows out radially, thereby further preventing oxidation of the lower portion of the graphite core.

A gas supply pipe may have split distal portions to allow effective radial flow of the gas. Alternatively, a gas supply hole (not shown) may be formed to allow the lower portion of the gas supply pipe to communicate with the outer circumferential portion of the graphite core which extends from the solidified distal portion of the molten metal to supply a gas. Other gas supply methods may also be proposed. It is essential to fill the inert gas in the lower graphite core portion and beside the hollow portion to prevent oxidation of the graphite core portion. A flow rate of the inert gas varies depending on the size of the billets and the type of gas. If the outer diameter of the billet is 300 to 500 mm, Ar (argon) gas is supplied at a rate of 0.3 to 3 l/min.

By casting the molten metal while its oxidation is prevented by an inert gas, thermal wear of the graphite core surface can be prevented. Corrosion and degradation of graphite are suppressed. Therefore, hollow billets having smooth inner surfaces can be stably manufactured.

Figure 7:
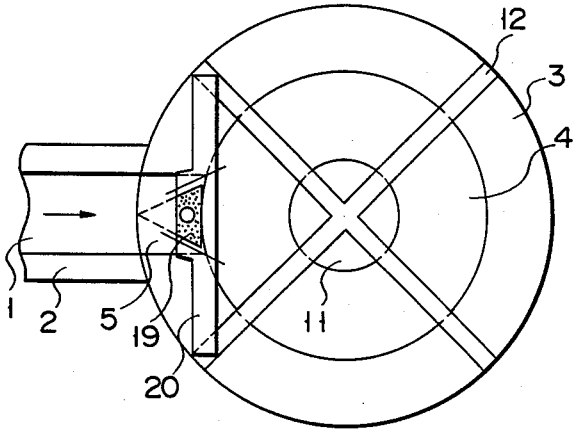
FIG. 7 is a top view of the arrangement shown in FIG. 6.
Figure 6:
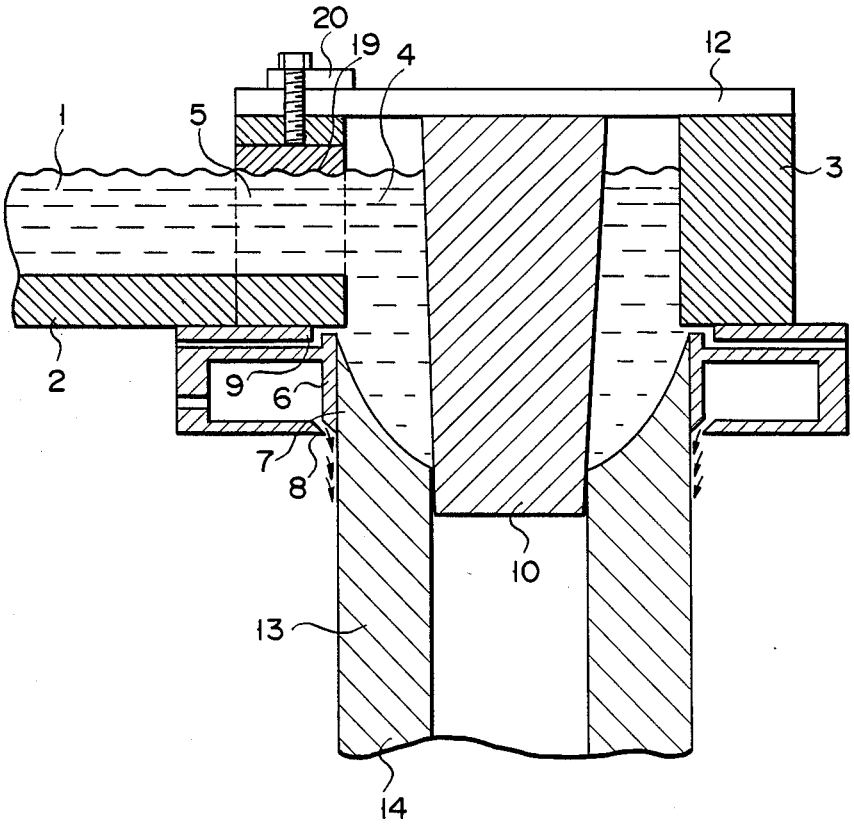
FIG. 6 is a view corresponding to FIG. 1, with a triangular flow regulating member disposed at the inlet to the refractory portion from the casting trough.

As shown in FIG. 6, for example, triangular flow regulating member 19 is disposed at molten metal flow inlet 5 to control the flow of the molten metal. Before the molten metal flowing from the casting trough directly collides against core 10, the molten metal flow is divided into right and left flows, as shown in FIG. 7. In this case, molten metal flow regulating member 19 is fixed by auxiliary support bar 20 placed on the molten metal flow inlet and a set screw. A flow regulating member consists of a refractory material such as Marinite, Lumiboard-L, and Recepal.

Figure 9:
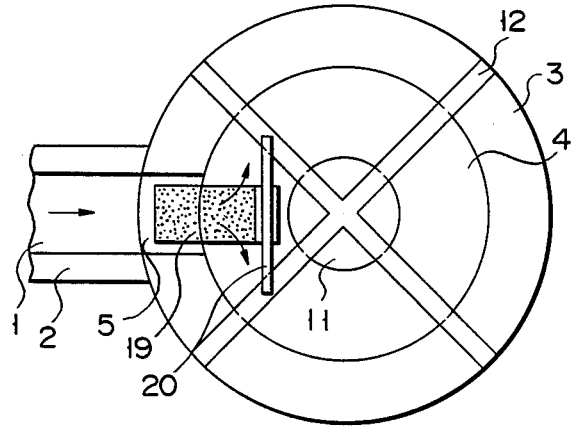
FIG. 9 is a top view of the arrangement shown in FIG. 6.
Figure 8:
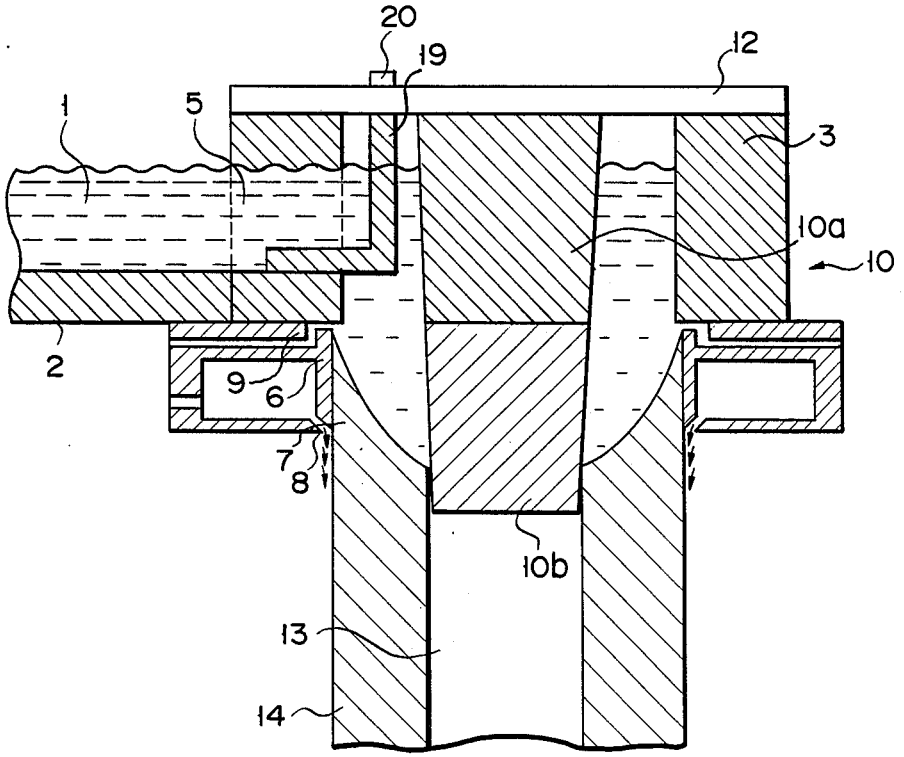
FIG. 8 is a view corresponding to FIG. 6, but showing an L-shaped flow regulating member.
Figure 1:
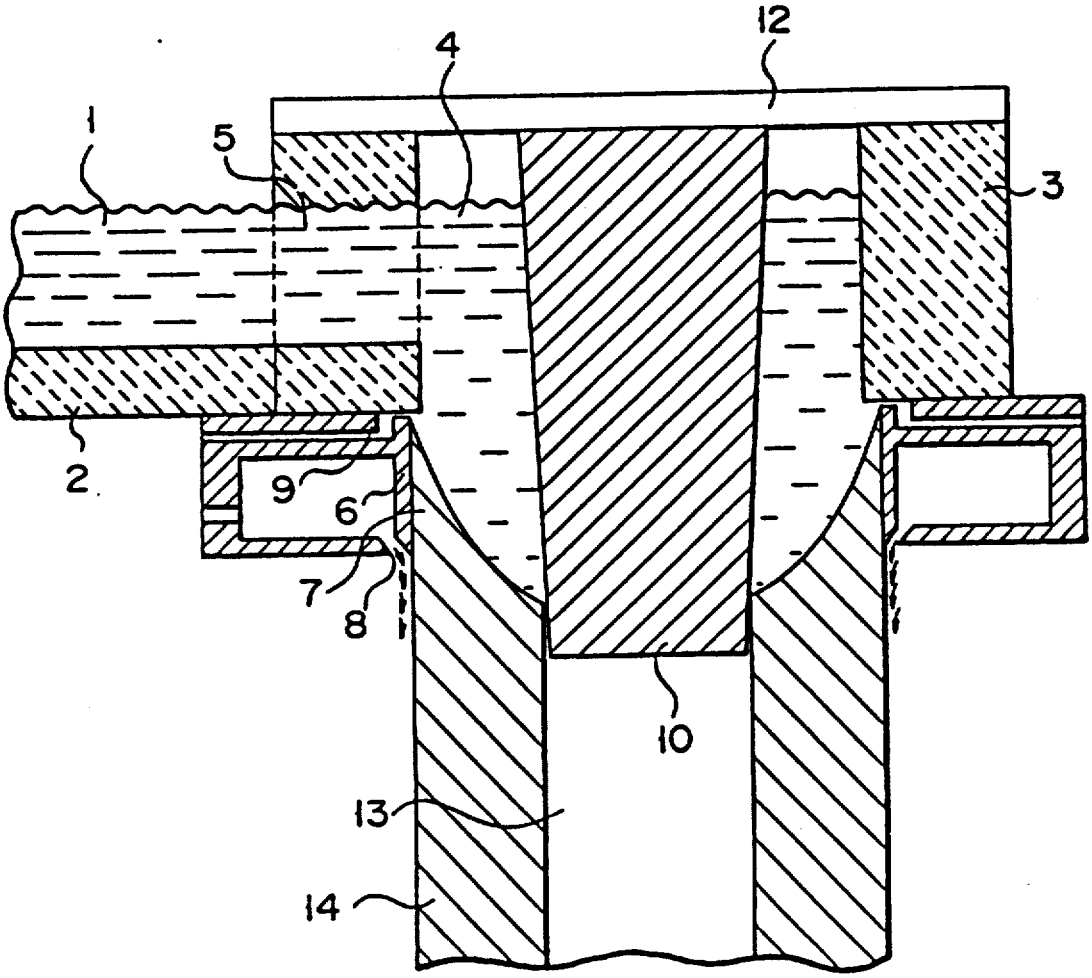
Figure 2:
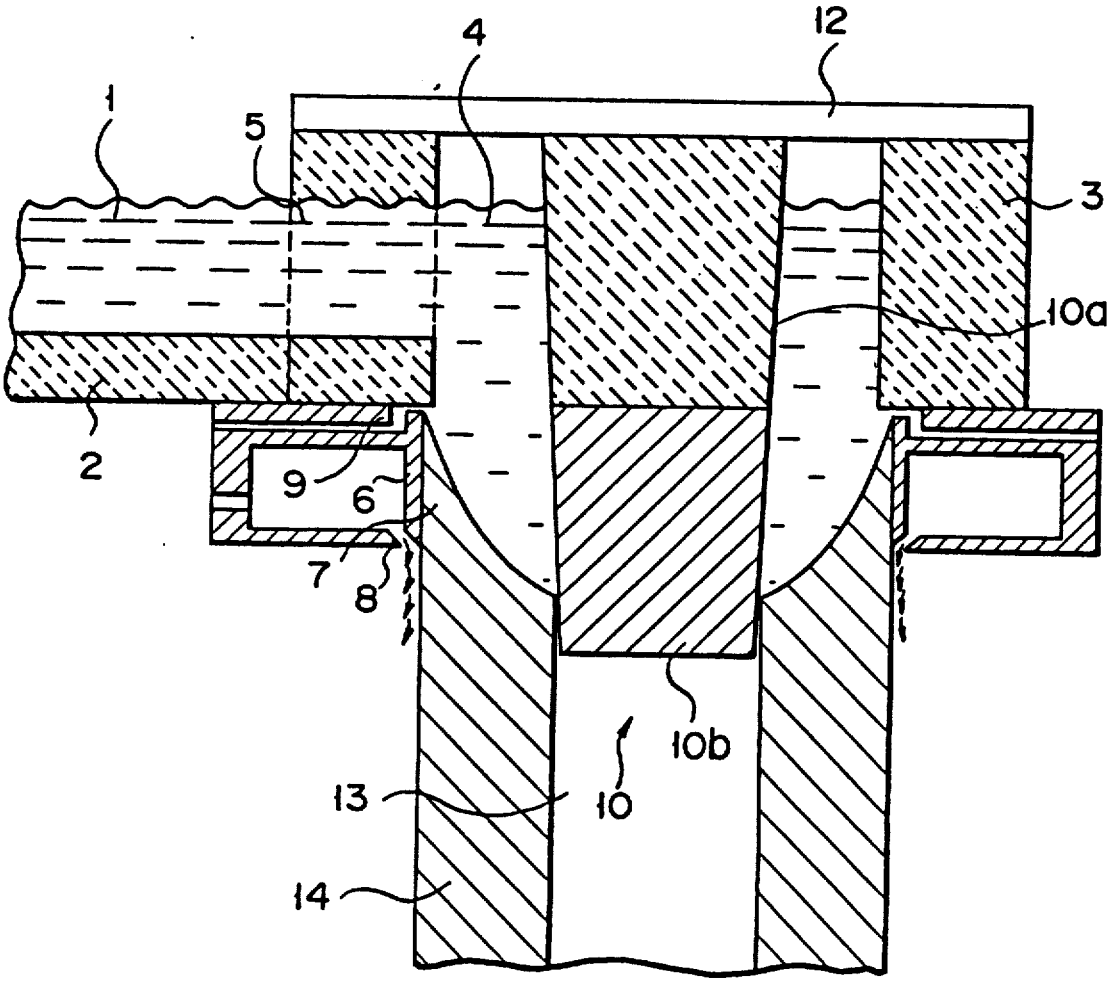
Figure 4:
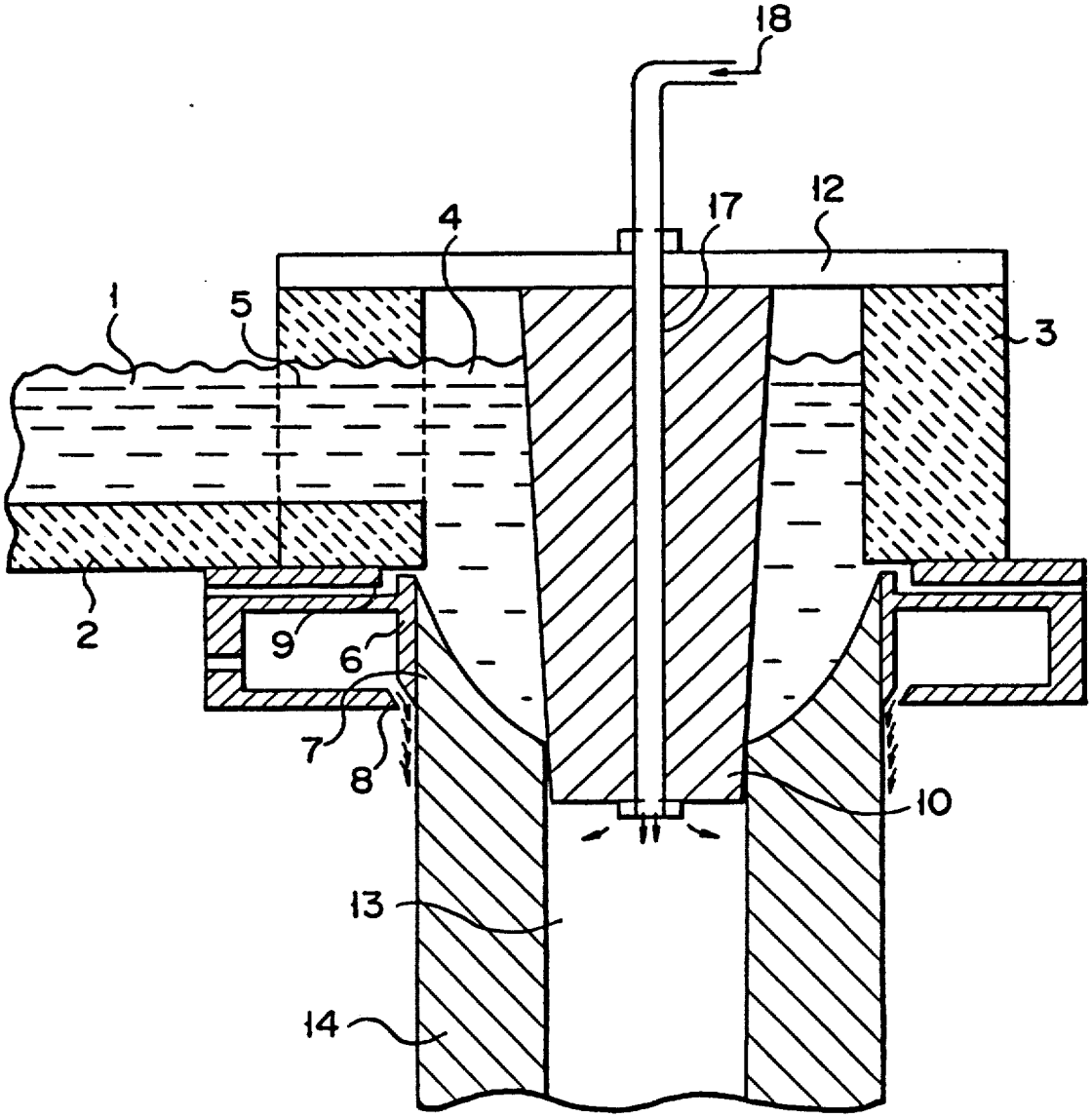
Figure 5:
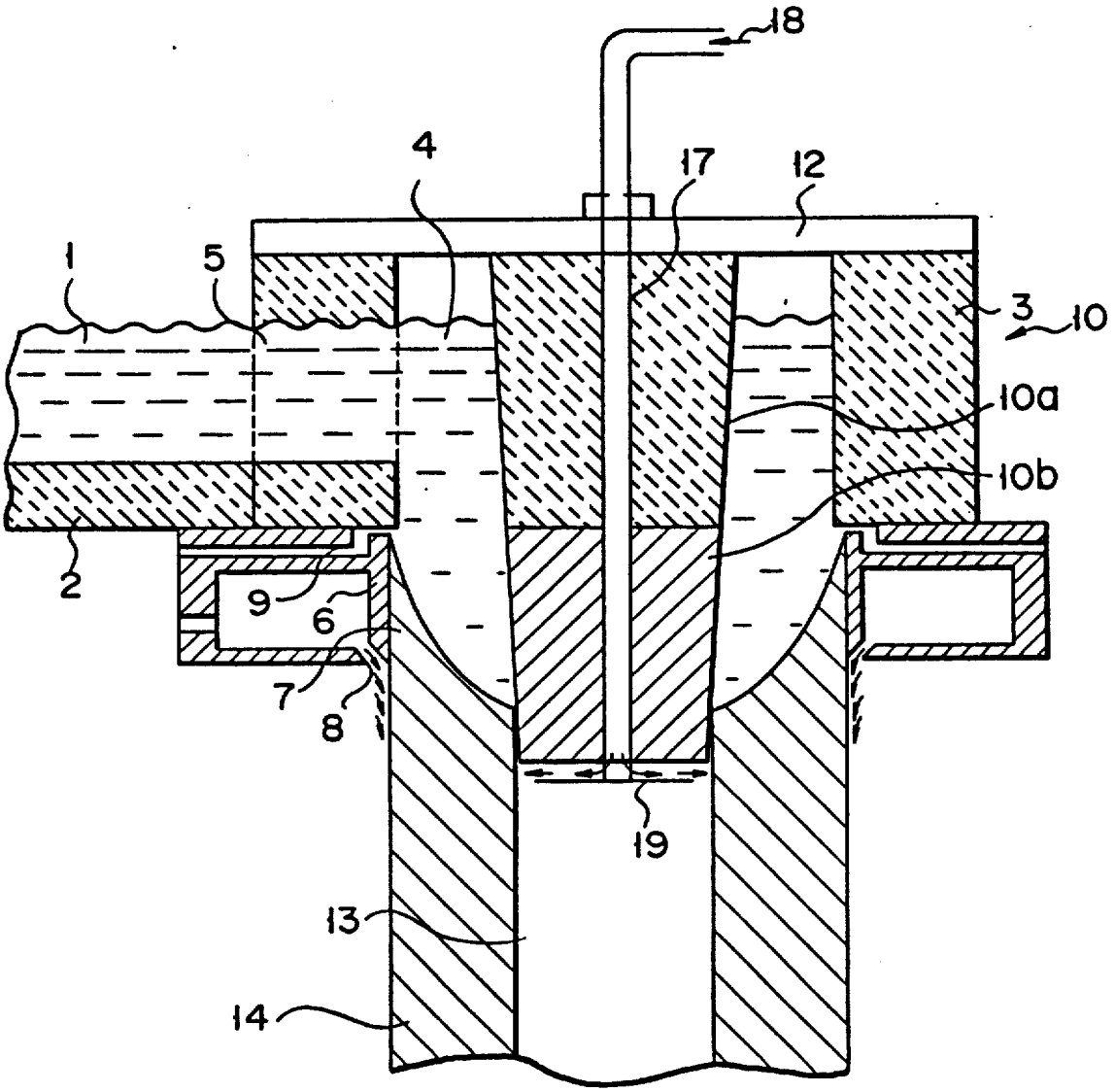
Figure 6:
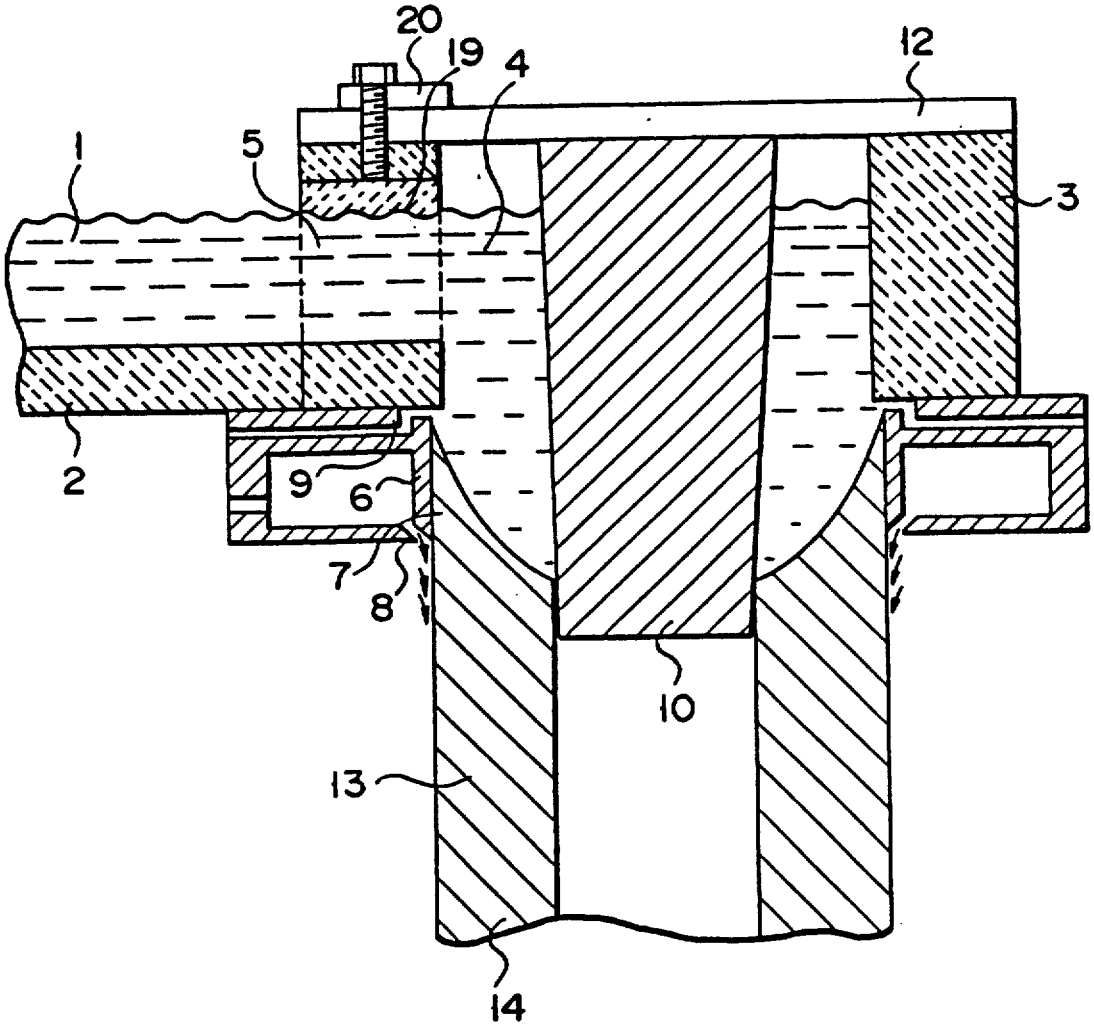
Figure 8:
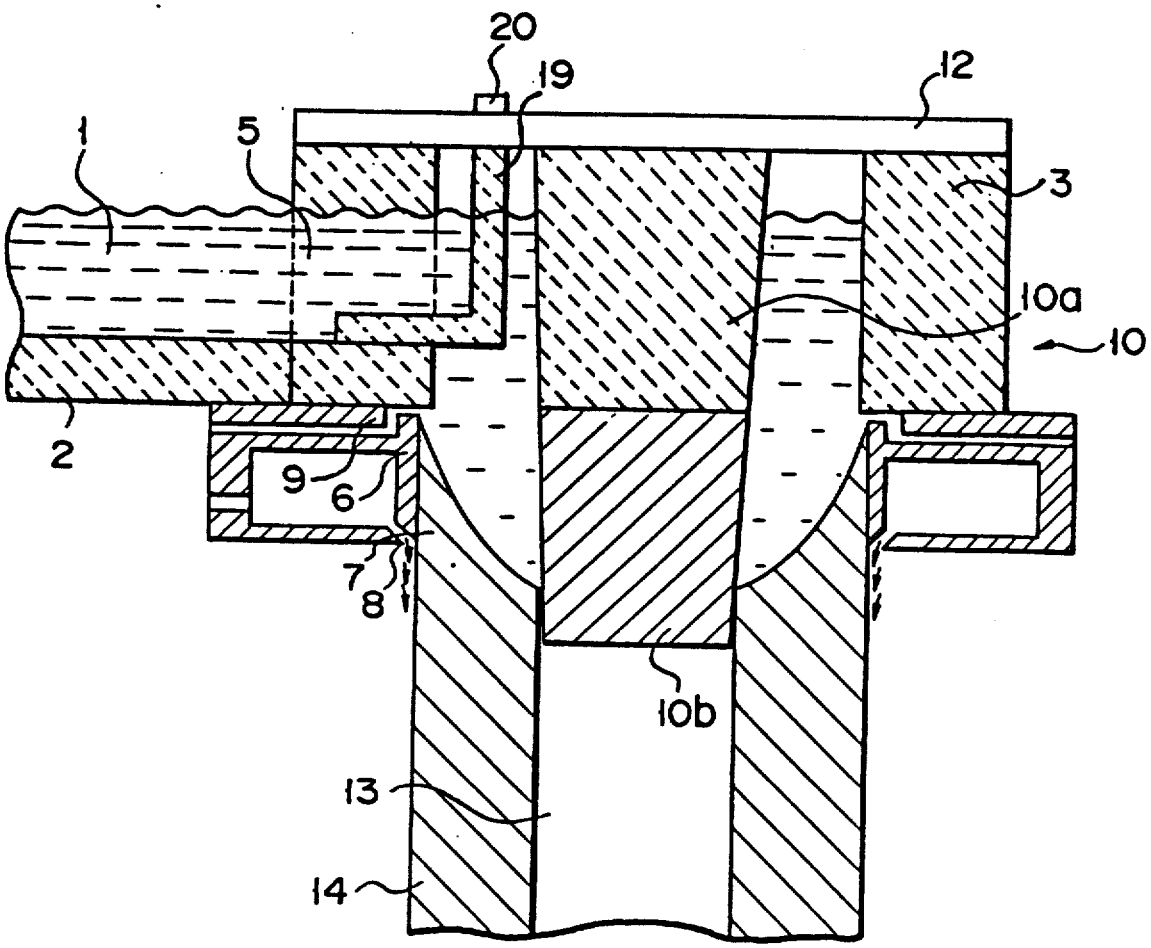

Another flow regulating member is inverted L-shaped molten metal flow regulating member 19 disposed in molten metal storing portion 4 in refractory portion 3, as shown in FIGS. 8 and 9. In this case, before the molten metal from the casting trough collides against the core, the molten metal is controlled to flow along the inner wall surface of upper refractory portion 3. This molten metal flow regulating member is fixed by auxiliary support bar 20 mounted on support bar 12 for supporting the core. The abrupt molten metal flow does not collide against the core due to the presence of the molten metal flow regulating member but is directed along the inner wall surface of the upper refractory portion. Therefore, solidification of the molten metal beside the core can be stabilized, and a high-quality billet free from internal defects and having a smooth hollow portion surface can be stably manufactured.

DETAILED DESCRIPTION OF THE PREFERRED EMBODIMENTS

Example 1

Example 1 exemplifies a case in which the present invention is applied to manufacture of a JIS 6061 alloy hollow billet having an outer diameter of 410 mm and an inner diameter of 120 mm.

An apparatus as shown in FIG. 1 was used. Marinite refractory material was used to form heat-insulating portion 3 for storing a molten metal. It is stacked on a copper alloy external water-cooled mold having a slit for supplying a lubricant. The mold had an inner diameter of 420 mm and a length of 75 mm. The slit was formed at a portion lower from the upper end by 1.0 mm. Molten metal flow runner 5 was formed in this heat-insulating portion so as to horizontally supply the molten metal from one direction. Core 10 consisted of a graphite integral body and had an overall length of 400 mm and a tapering angle of 5.5°. Core 10 was supported by the support bar from the upper portion of the heat-insulating portion.

Casting conditions were given as follows: a lowering rate was 70 mm/min; an amount of cooling water was 260 l/min; and a molten metal temperature was 685° C.

According to Example 1, although a large amount of molten metal was stored in the upper refractory portion, since a water-cooled core was not used, hollow billets could be safely and relatively easily manufactured according to hot top casting.

Example 2

Example 2 exemplifies a case in which the present invention is applied to manufacture of a JIS 6063 alloy billet having an outer diameter of 350 mm and an inner diameter of 120 mm.

An apparatus structure was a combination of an aluminum alloy external water-cooled mold having an inner diameter of 360 mm and a length of 75 mm and graphite core 11 having upper heat-insulating portion 10 formed of Marinite refractory material, as shown in FIG. 2.

Casting conditions were given as follows: a lowering rate was 80 mm/min; an amount of cooling water was 230 l/min; and a molten metal temperature was 685° C.

According to Example 2, hollow billets were safely and relatively easily manufactured without being influenced by molten metal level variations inherent to hot top casting for horizontally supplying the molten metal without using a movable portion for controlling the molten metal level. When a pipe extruded using the resultant billets was treated with mirror surface finish, neither an oxide nor defects inside the billet were detected. The billet was confirmed to have the same quality as that of a solid billet prepared by hot top casting.

Example 3

Example 3 exemplifies a case in which the present invention is applied to manufacture of a JIS 5052 alloy hollow billet having an outer diameter of 410 mm and an inner diameter of 220 mm.

An apparatus structure was a combination of an aluminum alloy external water-cooled mold having an inner diameter of 420 mm and a length of 75 mm and silicon nitride core 11 having upper heat-insulating portion 10 formed of Marinite refractory material, as shown in FIG. 2.

Casting conditions were given as follows: a lowering rate was 100 mm/min; an amount of cooling water was 200 l/min; and a molten metal temperature was 680° C.

According to Example 3, hollow billets were safely and relatively easily manufactured according to hot top casting. The hollow billet had a very smooth hollow surface in the static solidified portion.

Example 4

Example 4 exemplifies a case in which the present invention is applied to manufacture of a JIS 3003 alloy hollow billet having an outer diameter of 350 mm and an inner diameter of 80 mm.

An apparatus shown in FIG. 4 was used. Heat-insulating portion 3 made of Marinite refractory material for storing a molten metal was stacked on a copper alloy external water-cooled mold having a slit for supplying a lubricant. The mold had an inner diameter of 360 mm and a length of 75 mm. The slit was formed at a portion lower from the upper end by 1.0 mm. Molten metal flow runner 5 was formed in this heat-insulating portion so as to horizontally supply the molten metal from one direction. Core 10 consisted of a graphite integral body and had an overall length of 400 mm and a tapering angle of 5.5°. Core 10 was supported by the support bar from the upper portion of the heat-insulating portion.

Gas supply pipe 17 was disposed at the center of the graphite core to supply Ar gas, and the gas was filled in the lower graphite portion and near hollow portion 13, thereby cooling these portions. The flow rate of Ar gas was 0.8 l/min.

Casting conditions were given as follows: a lowering rate was 85 mm/min; an amount of cooling water was 220 l/min; and a molten metal temperature was 715° C. The casting length was given as 5.5 m, and semi-continuous casting was repeated three times (a 3-drop cycle). The inner surface of the resultant billet was very smooth. No thermal wear was found on the surface of the graphite surface by a visual observation after casting was completed.

Example 5

Example 5 exemplifies a case in which the present invention is applied to manufacture of a JIS 5052 alloy billet having an outer diameter of 410 mm and an inner diameter of 120 mm. In this case, an apparatus as in the apparatus (FIG. 4) in Example 4 was used except that a lower portion of the core was made of graphite, as shown in FIG. 5.

Casting conditions were given as follows: a lowering rate was 85 mm/min; an amount of cooling water was 220 l/min; a molten metal temperature was 685° C.; and a cast length was 5.5 m. Ar gas was supplied from a gas supply pipe near the hollow portion at a rate of 1.2 l/min, and semi-continuous casting was repeated five times (a 5-drop cycle). The inner surface of the billet was very smooth, and no trouble such as leakage of the molten metal occurred.

Example 6

Example 6 exemplifies a case in which the present invention is applied to manufacture of a JIS 3003 alloy hollow billet having an outer diameter of 350 mm and an inner diameter of 80 mm.

An apparatus shown in FIG. 6 was used. Heat-insulating portion 3 made of Marinite refractory material for storing a molten metal was stacked on a copper alloy external water-cooled mold having a slit for supplying a lubricant. The mold had an inner diameter of 360 mm and a length of 75 mm. The slit was formed at a portion lower from the upper end by 1.0 mm. Molten metal flow runner 5 was formed in this heat-insulating portion so as to horizontally supply the molten metal from one direction. Core 10 consisted of a graphite integral body and had an overall length of 400 mm and a tapering angle of 5.5°. Core 10 was supported by the support bar from the upper portion of the heat-insulating portion. Casting conditions were given as follows: a lowering rate was 85 mm/min; an amount of cooling water was 220 l/min; and a molten metal temperature was 715° C. A flow regulating plate (FIG. 6) of a regular triangle having a side length of 100 mm and a height of 120 mm was disposed at the center of the molten metal flow inlet having an inner wall distance of 150 mm. According to Example 6, although a large quantity of molten metal was stored in the upper refractory portion, since a water-cooled core was not used, hollow billets could be safely and relatively easily manufactured according to hot top casting. At the same time, molten metal leakage at the start of casting did not occur. The inner surface of the resultant billet was very smooth.

Example 7

The core shown in FIG. 8 and an external water-cooled mold and a heat-insulating portion as in Example 6 were used in Example 7 to cast a JIS 5052 alloy into hollow billets each having an outer diameter of 410 mm and an inner diameter of 120 mm. Casting conditions were given as follows: a lowering rate was 85 mm/min; an amount of cooling water was 220 l/min; and a molten metal temperature was 685° C. A flow regulating plate as shown in FIG. 8 was used. The flow regulating plate had a width of 120 mm, a height of 150 mm, an upper portion thickness of 12 mm, and a lower portion length of 150 mm. No molten metal leakage at the start of casting occurred, and the inner surface of the resultant billet was smooth. No trouble occurred.

What is claimed is:

1. A apparatus for manufacturing a hollow billet, said apparatus comprising:

a vertical semi-continuous casting mold including an upper refractory heat-insulating portion, a lower cooling portion, a lubricant supply port formed between the cooling portion and the heat-insulating portion, and a molten metal storing portion surrounded by the heat-insulating portion;

a solid core disposed at a central portion of the molten metal storing portion; and a through-hole formed in said solid core for supplying an inert gas to the interior of the hollow billet in the vicinity of said mold.

2. An apparatus according to claim 1, wherein the solid core is disposed in the molten metal storing portion such that the distal portion of the core is projected from the solidifying portion cooled by the lower cooling portion.

3. An apparatus according to claim 1, wherein the solid upper portion of the core is made of a refractory material, and the lower portion of the solid core is made of a material selected from the group consisting of graphite, silicon nitride, silicon carbide, and boron nitride.

4. A method of manufacturing a hollow billet, comprising the steps of:

disposing a solid core at a central portion of a molten metal storing portion surrounded by an upper refractory heat-insulating portion of a vertical semi-continuous casting mold comprising the heat-insulating portion, a lower cooling portion, and a lubricant supply port formed between the heat-insulating portion and the cooling portion, a lower portion of the solid core or the entire solid core consisting of graphite, and the core being positioned such that a distal portion of the solid core is dipped in the molten metal storing portion, so that the distal portion of the solid core is projected from the solidifying portion cooled by the lower cooling portion;

horizontally supplying, from one direction, a molten metal to the molten metal storing portion;

filling a hollow portion of the solidified distal portion with an inert gas supplied through a through-hole formed in the solid core; and casting the molten metal, with cooling being provided by the cooling portion, and an inner diameter of the solidified distal portion of the molten metal being controlled by the distal portion of the solid core.

5. A method of manufacturing a hollow billet, comprising the steps of:

disposing a solid core at a central portion of a molten metal storing portion surrounded by an upper refractory heat-insulating portion of a vertical semi-continuous casting mold comprising the heat-insulating portion, a lower cooling portion, and a lubricant supply port formed between the heat-insulating portion and the cooling portion;

horizontally supplying, from one direction, a molten metal to the molten metal storing portion, a direction of flow of said molten metal being controlled by a molten metal flow regulating member located at a molten metal flow inlet port; and casting the molten metal, with cooling being provided by the lower cooling portion, and an inner diameter of a solidified distal portion of the molten metal being controlled by a distal portion of the core.

6. An apparatus for manufacturing a hollow billet, said apparatus comprising:

a vertical semi-continuous casting mold including an upper refractory heat-insulating portion, a lower cooling portion, a lubricant supply port formed between the cooling portion and the heat-insulating portion, and a molten metal storing portion surrounded by the heat-insulating portion;

a solid core disposed at a central portion of the molten metal storing portion; and a molten metal flow regulating member located at a molten metal flow inlet port.

* * * * *

UNITED STATES PATENT AND TRADEMARK OFFICE
CERTIFICATE OF CORRECTION

PATENT NO. : 4,875,519

DATED : October 24, 1989

INVENTOR(S) : ISHII et al

It is certified that error appears in the above-identified patent and that said Letters Patent is hereby corrected as shown below:

The title page should be deleted to appear as per attached title page.

The sheets of drawings consisting of Figures 1, 2, 4, 5, 6 and 8 should be deleted to appear as per attached sheets.

Signed and Sealed this

Fifteenth Day of January, 1991

*Attest:*

HARRY F. MANBECK, JR.

*Attesting Officer*

*Commissioner of Patents and Trademarks*

United States Patent [19]

Ishii et al.

[11] Patent Number: 4,875,519

[45] Date of Patent: Oct. 24, 1989

[54] METHOD OF MANUFACTURING HOLLOW BILLET AND APPARATUS THEREFOR

[75] Inventors: Yoh Ishii, Oyama; Masami Abe, Tochigi; Yuhzoh Harada, Oyama; Atsumi Takasugi, Oyama; Kazumi Kato, Oyama, all of Japan

[73] Assignee: Furukawa Aluminum Co., Ltd., Tokyo, Japan

[21] Appl. No.: 185,436

[22] Filed: Apr. 25, 1988

[30] Foreign Application Priority Data

Apr. 30, 1987 [JP] Japan ..... 62-107749

[51] Int. Cl.[4] ..... B22D 11/04

[52] U.S. Cl. ..... 164/465; 164/421; 164/444; 164/475; 164/487

[58] Field of Search ..... 164/465, 421, 475, 487, 164/444

[56] References Cited

FOREIGN PATENT DOCUMENTS

| | | | |
|---|---|---|---|
| 837589 | 4/1952 | Fed. Rep. of Germany . | |
| 2321064 | 12/1974 | Fed. Rep. of Germany | 164/465 |
| 54-42847 | 12/1979 | Japan . | |
| 57-109546 | 7/1982 | Japan | 164/465 |
| 58-97463 | 6/1983 | Japan | 164/465 |
| 60-72645 | 4/1985 | Japan | 164/465 |
| 60-39456 | 9/1985 | Japan . | |
| 61-1961 | 1/1986 | Japan . | |
| 61-135452 | 6/1986 | Japan . | |
| 62-89549 | 4/1987 | Japan | 164/465 |

OTHER PUBLICATIONS

E. Lossak: Stranggiessen, 1986, Verlag DGM Informationsges, Oberursel, pp. 139–142; W. Schneider "Aluminium-Walzbarrenstrangguss mit Hot Top Kokillen".

*Primary Examiner*—Nicholas P. Godici
*Assistant Examiner*—J. Reed Batten, Jr.
*Attorney, Agent, or Firm*—Frishauf, Holtz, Goodman & Woodward

[57] ABSTRACT

A method and apparatus utilizing a core is located at a central portion of a molten metal storing portion in a vertical semi-continuous mold. The molten metal is poured into the molten metal storing portion, and casting takes place with the inner diameter of a solidified distal portion of the molten metal being controlled by a distal portion of the core. This approach provides a reliable method for the manufacture of high-quality hollow billets which are free from internal defects.

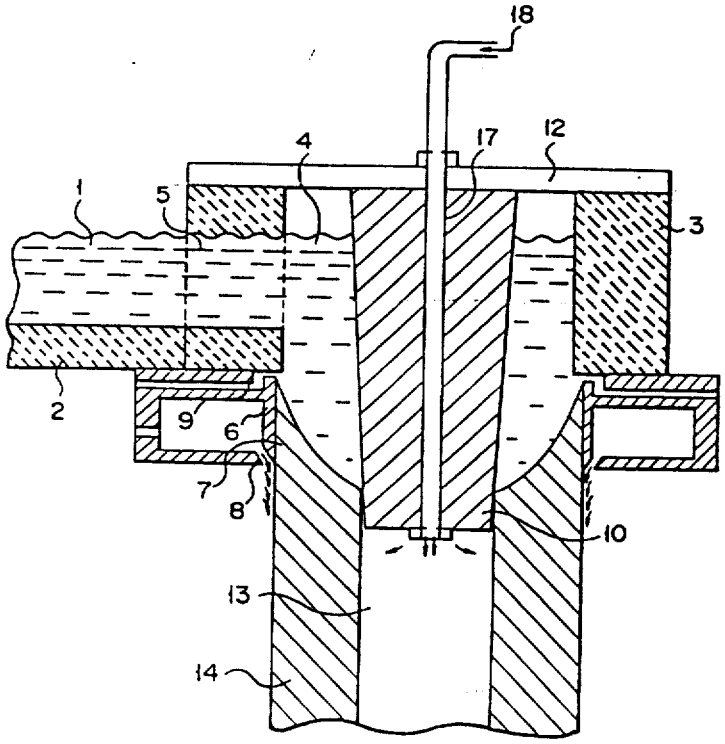

6 Claims, 7 Drawing Sheets